US005319302A

United States Patent [19]

Koshikawa et al.

[11] Patent Number: 5,319,302

[45] Date of Patent: Jun. 7, 1994

[54] SEMICONDUCTOR INTEGRATED CIRCUIT DEVICE HAVING VOLTAGE REGULATING UNIT FOR VARIABLE INTERNAL POWER VOLTAGE LEVEL

[75] Inventors: Yasuji Koshikawa; Tadahiko Sugibayashi; Takahiro Hara, all of Tokyo, Japan

[73] Assignee: NEC Corporation, Tokyo, Japan

[21] Appl. No.: 928,031

[22] Filed: Aug. 11, 1992

[30] Foreign Application Priority Data

Aug. 26, 1991 [JP] Japan ..... 3-212544

[51] Int. Cl.[5] ..... G05F 1/56

[52] U.S. Cl. ..... 323/273; 323/274; 323/281

[58] Field of Search ..... 323/265, 267, 273, 274, 323/281, 282, 349, 350, 351

[56] References Cited

U.S. PATENT DOCUMENTS

| | | | |
|---|---|---|---|
| 4,585,955 | 4/1986 | Uchida | 323/281 X |
| 4,731,574 | 3/1988 | Melbert | 323/275 |
| 5,077,518 | 12/1991 | Han | 323/275 |
| 5,079,497 | 1/1992 | Barbu et al. | 323/281 |
| 5,146,152 | 9/1992 | Jin et al. | 323/281 X |

OTHER PUBLICATIONS

"Dual-Regulator Dual-Decoding-Trimmer DRAM Voltage Limiter For Burn-In Test", pp. 127-128, No Date.

*Primary Examiner*—Emanuel T. Voeltz
*Attorney, Agent, or Firm*—Sughrue, Mion, Zinn, Macpeak & Seas

[57] ABSTRACT

A semiconductor integrated circuit device is equipped with an internal power source unit for distributing an internal power voltage level between component circuitries, and the internal power voltage level is regulated to a variable reference voltage level, wherein a first main voltage regulator regulates the variable reference voltage level to a primary reference voltage level before reaching a threshold voltage level; however, after the primary reference voltage level becomes lower than the threshold voltage level, a latching circuit supplies an activation signal to a second main voltage regulator, and the second main voltage regulator regulates the variable reference voltage level to a secondary reference voltage level so that the second main voltage regulator continuously controls the variable voltage level without any abrupt transition, thereby allowing the internal power source unit to adjust the internal power voltage level to an arbitrary point.

6 Claims, 10 Drawing Sheets

SEMICONDUCTOR INTEGRATED CIRCUIT DEVICE HAVING VOLTAGE REGULATING UNIT FOR VARIABLE INTERNAL POWER VOLTAGE LEVEL

FIELD OF THE INVENTION

This invention relates to a semiconductor integrated circuit device and, more particularly, to a voltage regulating unit incorporated in the semiconductor integrated circuit device for producing a variable internal power voltage level.

DESCRIPTION OF THE RELATED ART

Semiconductor integrated devices have been increased in integration density, and the manufacturer miniaturizes the circuit components. Such a miniaturized circuit component tends to be damaged by a standard electric power voltage shared between an electronic system, and, for this reason, a semiconductor integrated circuit device presently available are equipped with a step-down circuit for producing an internal power voltage level lower than the standard electric power voltage level. However, while the semiconductor integrated circuit device is subjected to an inspection before delivery from the manufacturing facility, the internal power voltage level is increased for the inspection, and the increased internal power voltage level accelerates fault in the semiconductor integrated circuit device, if any. Such an acceleration effectively screens out products, and enhances the reliability of the semiconductor integrated circuit.

FIG. 1 shows a typical example of the semiconductor integrated circuit device equipped with an internal step-down circuit, and comprises a preliminary reference voltage generator 1, a preliminary voltage regulator 2, a controller 3, a voltage divider 4 and two main voltage regulators 5 and 6. The preliminary reference voltage generator 1 produces a preliminary reference voltage Vref from a power voltage level Vcc supplied from the outside thereof, and the reference voltage Vref is supplied to the preliminary voltage regulator 2. The preliminary voltage regulator 2 comprises a comparator 2*a* and a series combination of a p-channel enhancement type load transistor 2*b* and resistors 2*c* and 2*d* coupled between the power voltage line Vcc and a ground voltage line GND. The comparator 2*a* is coupled at one input node with the preliminary reference voltage generator 1 and at the other input node with an intermediate node N1 between the resistors 2*c* and 2*d*, and compares the preliminary reference voltage level Vref with the voltage level at the intermediate node N1. While the voltage level at the intermediate node N1 is equal to the preliminary reference voltage level Vref, the comparator 2*a* keeps the output voltage signal constant, and the p-channel enhancement type load transistor 2*b* also keeps the resistance thereof constant. However, if the voltage level at the intermediate node N1 is decayed under the reference voltage level Vref, the comparator 2*a* lowers the output voltage signal, and the p-channel enhancement type load transistor 2*b* decreases the resistance thereof so as to lift the voltage level at the intermediate node N1. On the other hand, if the voltage level at the intermediate node N1 exceeds the preliminary reference voltage level Vref, the comparator increases the output voltage signal, and the p-channel enhancement type load transistor 2*b* increases the resistance thereof. Then, the voltage level at the intermediate node N1 is lowered. Thus, the preliminary voltage regulator 2 regulates the voltage level at the intermediate node N1 to the preliminary reference voltage level Vref, and, accordingly, keeps a primary reference voltage level Vref1 at the output node N2 thereof higher than the preliminary reference voltage level Vref by a predetermined value. The primary reference voltage level Vref1 at the output node N2 is supplied to the controller 3 and the main voltage regulator 5.

The controller 3 largely comprises a comparator 3*a*, an inverter 3*b* and a series combination of three inverters 3*c*, 3*d* and 3*e*. The comparator comprises two series combinations of p-channel enhancement type load transistors 3*f* and 3*g* and n-channel enhancement type amplifying transistors 3*h* and 3*i* coupled between the power voltage line Vcc and a common node N3, and an n-channel enhancement type activation transistor 3*j* coupled between the node N3 and the ground voltage line GND. The two p-channel enhancement type load transistors 3*f* and 3*g* are equal in transistor characteristics to each other, and the p-channel enhancement type load transistor 3*h* is also equal in transistor characteristics to the n-channel enhancement type load transistor 3*i*. An external controlling signal PON is supplied to the inverter 3*b*, and the n-channel enhancement type activation transistor 3*j* is gated by the inverter 3*b* with the complementary signal CPON of the external controlling signal PON. A common drain node N4 between the p-channel enhancement type load transistor 3*g* and the n-channel enhancement type amplifying transistor 3*i* serves as an output node of the comparator 3*a*, and is coupled with the input node of the inverter 3*c*. The voltage divider 4 is fabricated from a series combination of an n-channel enhancement type activation transistor 4*a* and three resistors 4*b*, 4*c* and 4*d* coupled between the power voltage line Vcc and the ground voltage line GND, and the n-channel enhancement type activation transistor 4*a* is directly gated with the external controlling signal PON. Two output nodes N5 and N6 are provided between the resistors 4*b*, 4*c* and 4*d*, and the primary reference voltage level Vref1 and the threshold voltage level BREF at the output node N6 are respectively supplied to the gate electrodes of the n-channel enhancement type amplifying transistors 3*h* and 3*i*. Since the gate electrodes of both p-channel enhancement type load transistors 3*f* and 3*g* are coupled with the common drain node between the p-channel enhancement type load transistor 3*f* and the n-channel enhancement type amplifying transistor 3*h*, the p-channel enhancement type load transistors 3*f* and 3*g* are equal in channel resistance to each other. However, the n-channel enhancement type amplifying transistors 3*h* and 3*i* are variable in channel conductance depending upon the voltage levels at the gate electrodes. Therefore, if the primary reference voltage level Vref1 is higher than the voltage level BREF at the output node N6, the common drain node N7 is decreased, and the output node N4 goes up to high voltage level. Then, the inverter circuit 3*e* keeps an activation signal BIDM in inactive low voltage level. However, if the voltage level BREF at the output node N6 becomes higher than the primary reference voltage Vref1, the output node N4 goes down, and the activation signal BIDM is lifted to active high voltage level.

The main voltage regulator 5 comprises a comparator 5*a* and a p-channel enhancement type load transistor 5*b*. The comparator 5*a* compares the voltage level at the drain node N8 of the p-channel enhancement type load transistor 5*b* with the primary reference voltage Vref1, and controls the channel conductance of the p-channel enhancement type load transistor 5*b*. Namely, if the voltage level at the drain node N8 is higher than the primary reference voltage Vref1, the comparator 5*a* increases the output voltage signal thereof, and, accordingly, causes the p-channel enhancement type load transistor 5*b* to increase the channel resistance thereof. Then, the voltage level at the drain node N8 is lowered, and is balanced with the primary reference voltage Vref1. On the other hand, if the voltage level at the drain node N8 becomes lower than the primary reference voltage Vref1, the comparator 5*a* decreases the output voltage signal thereof, and the channel resistance of the p-channel enhancement type load transistor 5*b* is decreased. As a result, the voltage level at the drain node N8 goes up, and is balanced with the primary reference voltage Vref1. Thus, the main voltage regulator 5 regulates the voltage level at the drain node N8 at the primary reference voltage Vref1.

The other main voltage regulator 6 also comprises a comparator 6*a* and a p-channel enhancement type load transistor 6*b*. The comparator 6*a* is similar in circuit arrangement to the comparator 3*a*, and a p-channel enhancement type load transistor 6*c* and the n-channel enhancement type load transistor 6*d* are equal in transistor characteristics to the p-channel enhancement type load transistor 6*e* and the n-channel enhancement type load transistor 6*f*. An n-channel enhancement type activation transistor 6*g* is turned on in the presence of the activation signal BIDM, and the comparator 6*a* compares the voltage level at the drain node N9 of the p-channel enhancement type load transistor 6*b* with a secondary reference voltage level BIV at the output node N5 of the voltage divider 4. Namely, if the voltage level at the drain node N9 is higher than the secondary reference voltage level BIV at the output node N5, the comparator 6*a* increases the output voltage signal thereof, and, accordingly, causes the p-channel enhancement type load transistor 6*b* to increase the channel resistance thereof. Then, the voltage level at the drain node N9 is lowered, and is balanced with the secondary reference voltage level BIV at the output node N5. On the other hand, if the voltage level at the drain node N9 becomes lower than the secondary reference voltage level BIV at the output node N5, the comparator 6*a* decreases the output voltage signal thereof, and the channel resistance of the p-channel enhancement type load transistor 6*b* is decreased. As a result, the voltage level at the drain node N9 goes up, and is balanced with the secondary reference voltage level BIV at the output node N5. Thus, the main voltage regulator 6 regulates the voltage level at the drain node N9 at the secondary reference voltage level BIV at the output node N5 depending upon the activation signal BIDM and, accordingly, the voltage level BREF at the output node N6 of the voltage divider 4. Although the nodes N8 and N9 are coupled with each other, the main voltage regulators 5 and 6 regulates the variable reference voltage level Vref3 to higher voltage level between the nodes N8 and N9.

The drain nodes N8 and N9 are coupled with an internal reference node N10, and the internal reference node N10 is adjusted to the voltage level at either drain node N8 or N9 regulated to one of the primary reference voltage Vref1 and the secondary reference voltage level BIV. The internal reference node N10 in turn is coupled with an internal power supply unit 7, and the internal power supply unit regulates an internal power voltage level IVcc to a variable reference voltage level Vref3 at the internal reference node N10 for distributing to other component circuits of the semiconductor integrated circuit device. The secondary reference voltage level BIV is higher than the preliminary reference voltage level Vref, and the inspection is carried out with the internal power voltage level IVcc regulated to the voltage level BREF. However, the internal power voltage level IVcc is regulated to the primary reference voltage level Vref1 in standard operation.

Turning to FIG. 2, the circuit arrangements of the preliminary reference voltage generator 1, the preliminary voltage regulator 2 and the main voltage regulator 3 are illustrated in detail. The preliminary reference voltage generator 1 comprises a first series combination of p-channel enhancement type load transistors 1*a*, 1*b* and 1*c* coupled between the power voltage line Vcc and the ground voltage line GND, a second series combination of a p-channel enhancement type load transistor 1*d* and an n-channel enhancement type load transistor 1*e* coupled between the power voltage line Vcc and the ground voltage line GND, a third series combination of p-channel enhancement type load transistors 1*f*, 1*g* and 1*h* coupled between the power voltage line Vcc and the ground voltage line GND, and a fourth series combination of p-channel enhancement type load transistors 1*i*, 1*j* and 1*k* and an n-channel enhancement type load transistor 1 m coupled between the power voltage line Vcc and the ground voltage line GND. The first series combination has an intermediate node N11 between the p-channel enhancement type load transistors 1*b* and 1*c*, and the voltage level at the intermediate node N11 controls the p-channel enhancement type load transistors 1*d*, 1*f* and 1*i* of the second to fourth series combinations. Moreover, the drain nodes N12 and N13 of the p-channel enhancement type load transistors 1*f* and 1*i* are coupled with each other. The common drain node N14 between the enhancement type load transistors 1*d* and 1*e* is coupled with the gate electrode of the n-channel enhancement type load transistor 1 m, and the voltage level at the common drain node N14 controls the channel resistance of the n-channel enhancement type load transistor 1*m*.

The p-channel enhancement type load transistors 1*g* and 1*h* are larger in the absolute value of the threshold level |Vtp1| than the other p-channel enhancement type load transistors 1*a* to 1*d*, 1*f* and 1*i* to 1*k*. The absolute value of the threshold level |Vtp| is indicated by combination of Vtp and the reference assigned to the p-channel enhancement type load transistor. For example, Vtp1*g*, Vt1*h*, Vtp1*j* and Vtp1*k* are indicative of the absolute values of threshold for the p-channel enhancement type load transistors 1*g*, 1*h*, 1*j* and 1*k*, respectively. While the power voltage level Vcc is equal to or greater than the sum of the absolute values Vtp1*g* and Vtp1*h*, the preliminary reference voltage level Vref is given by Equation 1.

$$Vref = Vtp1g + Vtp1h - Vtp1j - Vtp1k \qquad \text{Equation 1}$$

This is because of the fact that the p-channel enhancement type load transistors 1*d*, 1*f* and 1*i* are equal in current driving capability to one another so as to achieve a current mirror function.

The comparator 2*a* comprises two series combinations of p-channel enhancement type load transistors 2*e* and 2f and n-channel enhancement type amplifying transistors 2g and 2h coupled between the power voltage line Vcc and a common node N15, and an n-channel enhancement type load transistor 2i coupled between the common node N15 and the ground voltage line GND. The p-channel enhancement type load transistors 2e and 2f have respective gate electrodes coupled with the drain node N16 of the p-channel enhancement type load transistor 2e, and provide resistances equal to each other. The n-channel enhancement type load transistor 2i has a gate electrode coupled with the power voltage line Vcc, and serve as a constant current source. The preliminary reference voltage level Vref and the voltage level at the intermediate node N1 are respectively supplied to the gate electrodes of the n-channel enhancement type amplifying transistors 2g and 2h, and are compared with each other. The voltage level at the other common drain node N17 is varied with the differential voltage level between the gate electrodes of the n-channel enhancement type amplifying transistors 2g and 2h, and the output voltage signal of the comparator 2a is supplied from the common drain node N17 to the gate electrode of the p-channel enhancement type load transistor 2b.

As described hereinbefore, the preliminary reference voltage level Vref is supplied to the preliminary voltage regulator 2. Since the p-channel enhancement type load transistor 2e and the n-channel enhancement type load transistor 2g are respectively equal in transistor characteristics to the p-channel enhancement type load transistor 2f and the n-channel enhancement type load transistor 2h, the voltage level at the intermediate node N1 is regulated to the preliminary reference voltage level Vref, and the primary reference voltage level Vref1 is higher than the preliminary reference voltage level Vref by the predetermined value. If the resistors 2c and 2d produces respective resistance R2c and R2d, the primary reference voltage level Vref1 is given by Equation 2.

$$Vref1 = Vref \times (R2c + R2d)/R2d \qquad \text{Equation 2}$$

After the power voltage level Vcc exceeds a certain voltage level, the primary reference voltage level Vref1 is kept constant.

The comparator 5a is similar in circuit arrangement to the comparator 2a, and comprises two series combinations of p-channel enhancement type load transistors 5c and 5d and n-channel enhancement type amplifying transistors 5e and 5f coupled between the power voltage line Vcc and a common node N18, and an n-channel enhancement type load transistor 5g coupled between the common node N18 and the ground voltage line GND. The p-channel enhancement type load transistors 5c and 5d have respective gate electrodes coupled with the drain node N19 of the p-channel enhancement type load transistor 5c, and, accordingly, provide resistances equal to each other. The n-channel enhancement type load transistor 5g has a gate electrode coupled with the power voltage line Vcc, and serve as a constant current source. The voltage levels at the output nodes N2 and N8 are respectively supplied to the gate electrodes of the n-channel enhancement type amplifying transistors 5e and 5f, and are compared with each other. The voltage level at the other common drain node N20 is varied with the differential voltage level between the gate electrodes of the n-channel enhancement type amplifying transistors 5e and 5f, and the output voltage signal of the comparator 5a is supplied from the common drain node N20 to the gate electrode of the p-channel enhancement type load transistor 5b. The p-channel enhancement type load transistor 5c and the n-channel enhancement type amplifying transistor 5e are respectively equal in transistor characteristics to the p-channel enhancement type load transistor 5d and the n-channel enhancement type amplifying transistor 5f, and, for this reason, the voltage level at the output node N8 is regulated to the primary reference voltage level Vref1.

Turning back to FIG. 1 of the drawings, the comparator 3a is activated with the complementary signal CPON produced from the external controlling signal PON as described hereinbefore. Though not shown in the drawings, an external signal generator produces the external controlling signal PON, and the external controlling signal PON rises together with the power voltage level Vcc after switch-on of the power voltage Vcc. However, when the power voltage level Vcc reaches 3.0 volts, the external signal generator shifts the external controlling signal PON to the ground voltage level as shown in FIG. 3, and, accordingly, the inverter 3b conducts the signal line for the complementary signal CPON with the power voltage line Vcc. On the other hand, the voltage levels BIV and BREF at the intermediate node N5 and N6 are respectively given from Equations 3 and 4.

$$BIV = Vcc \times (R4c + R4d)/(R4b + R4c + R4d) \qquad \text{Equation 3}$$

$$BREF = Vcc \times R4d/(R4b + R4c + R4d) \qquad \text{Equation 4}$$

where R4b, R4c and R4d are resistances of the resistors 4b, 4c and 4d. Therefore, the activation signal BIDM remains in the ground voltage level or zero volt while the primary reference voltage level Vref1 is greater than $\{Vcc \times R4d/(R4b + R4c + R4d)\}$. However, if the primary reference voltage level Vref1 is less than $\{Vcc \times R4d/(R4b + R4c + R4d)\}$, the activation signal BIDM goes up to the power voltage level Vcc.

Since the activation signal BIDM of the power voltage level activates the main voltage regulator 6, the variable reference voltage level Vref3 is regulated to either primary or secondary reference voltage level Vref1 or BIV depending upon the relation between the voltage level BREF and the primary reference voltage level Vref1. Namely, while the primary reference voltage level Vref1 is greater than the voltage level BREF or $\{Vcc \times R4d/(R4b + R4c + R4d)\}$, the main voltage regulator 5 controls the internal reference node N10, and the variable reference voltage level Vref3 is regulated to the primary reference voltage level Vref1. In this situation, the primary reference voltage level Vref1 and, accordingly, the variable reference voltage level Vref3 is given by Equation 5.

$$Vref3\ (Vref1) = Vcc \times (R2c + R2d)/R2d \qquad \text{Equation 5}$$

where R2c and R2d are respective resistances of the resistors 2c and 2d.

However, if the primary reference voltage level Vref1 is less than the voltage level BREF or $\{Vcc \times R4d/(R4b + R4c + R4d)\}$, the internal reference node N10 is controlled by the other main voltage regulator 6, and the variable reference voltage level Vref3 is regulated to the secondary reference voltage level BIV. The variable reference voltage level Vref3 is given by Equation 6.

$$Vref3 = Vcc \times (R4c + R4d)/(R4b + R4c + R4d) \quad \text{Equation 6}$$

Of course, if the primary reference voltage level Vref1 is greater than the secondary reference voltage level BIV, the main voltage regulator 6 regulates the internal reference node N10, and the variable reference voltage level Vref3 is equal to the primary reference voltage level Vref1 as expressed by Equation 7.

$$Vref3 = Vcc \times (R2c + R2d)/R2d \quad \text{Equation 7}$$

The relation between the variable reference voltage level Vref3 and the power voltage level Vcc is summarized in FIG. 4 on the assumption that Vref = 1.50 volt R2c:R2d = 6:5

(R4b + R4c):R4d = 37:33 and

R4b:(R4c + R4d) = 2:5

As illustrated in FIG. 4, the variable reference voltage level Vref3 is equal to the primary reference voltage level Vref1 in so far as the power voltage level Vcc is greater than 3.0 volts and less than 7.0 volts. However, if the power voltage level Vcc exceeds 7.0 volts, the variable reference voltage level Vref3 is regulated to the secondary reference voltage level BIV.

However, a problem is encountered in the prior art semiconductor integrated circuit device in that the internal power voltage level IVcc is unstable when the power voltage level vcc is adjusted around the abrupt transient region. In the example shown in FIG. 4, the abrupt transient region takes place at 7.0 volts where the control of the variable reference voltage level Vref3 is relayed between the main voltage regulators 5 and 6.

SUMMARY OF THE INVENTION

It is therefore an important object of the present invention to provide a semiconductor integrated circuit device the voltage regulating unit of which improves stability of an internal power voltage level regardless of an external power voltage level.

To accomplish the object, the present invention proposes to latch an activation signal supplied to a second main voltage regulator.

In accordance with the present invention, there is provided a semiconductor integrated circuit device comprising: a) an internal power source unit operative to produce an internal power voltage level regulated to a variable reference voltage level; and b) a reference voltage generating unit operative to produce the variable reference voltage level, and comprising b-1) a preliminary reference voltage generator for producing a preliminary reference voltage level from an external power voltage level, b-2) a preliminary voltage regulator responsive to the preliminary reference voltage level for producing a primary reference voltage level, b-3) a secondary reference voltage generator responsive to an external controlling signal for producing a secondary reference voltage level and a threshold voltage level from the external power voltage level, b-4) a first main voltage regulator responsive to the primary reference voltage level for regulating the variable reference voltage level to the primary reference voltage level while the primary reference voltage level is higher than the threshold voltage level, b-5) a controller enabled with the external controlling signal, and operative to compare the primary reference voltage level with the threshold voltage level for producing an activation signal, b-6) a latching means shifted to a reset state with a reset signal, and latching the activation signal from the controller, and b-7) a second main voltage regulator activated with the activation signal supplied from the latching means, and responsive to the secondary reference signal for regulating the variable reference voltage level to the secondary reference voltage level after the primary reference voltage level becomes lower than the threshold voltage level.

BRIEF DESCRIPTION OF THE DRAWINGS

The features and advantages of the semiconductor integrated circuit device according to the present invention will be more clearly understood from the following description taken in conjunction with the accompanying drawings in which.

DESCRIPTION OF THE PREFERRED EMBODIMENTS

First Embodiment

Figure 5:
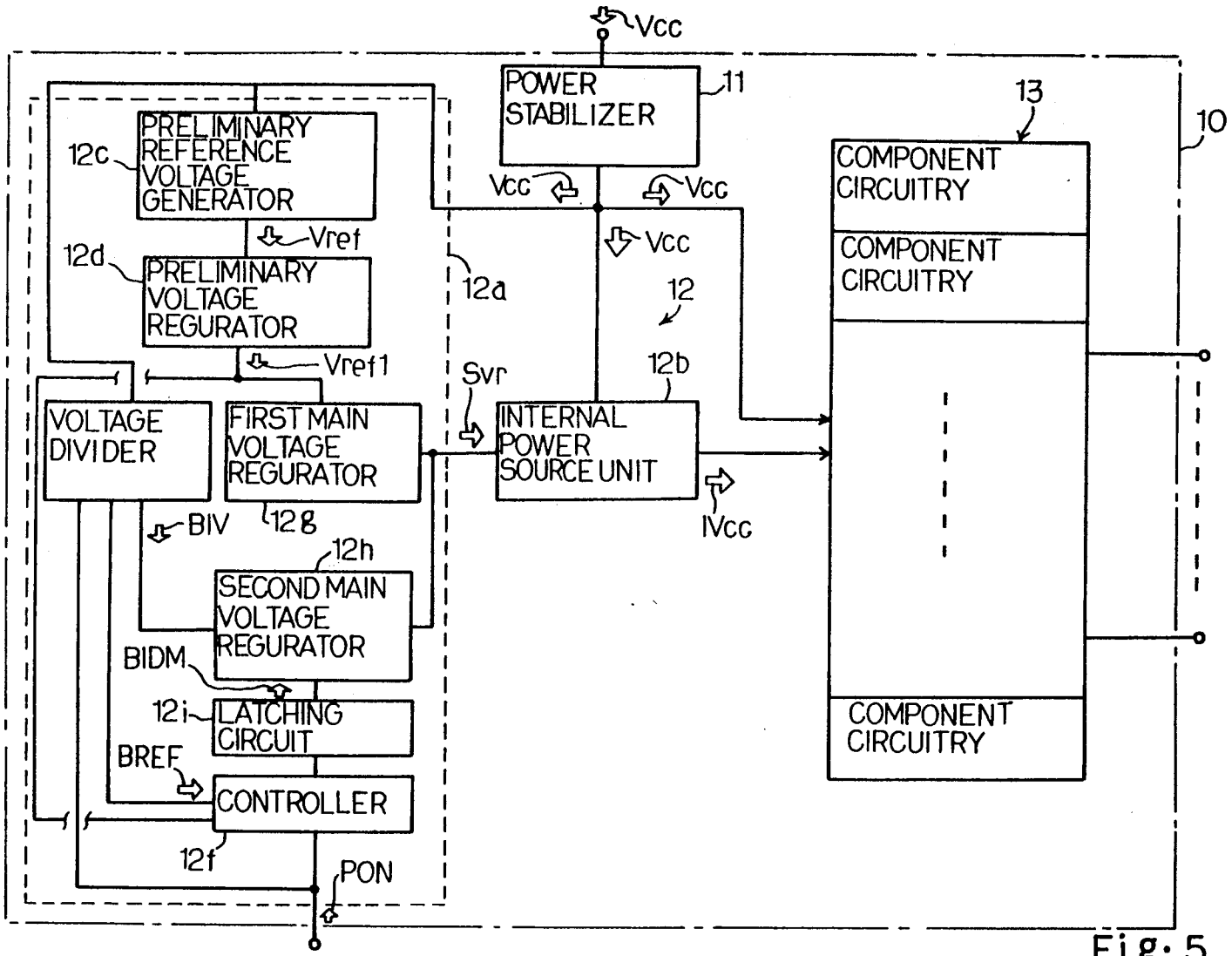
FIG. 5 is a block diagram showing the circuit arrangement of a semiconductor integrated circuit device according to the present invention.

Referring to FIG. 5 of the drawings, a semiconductor integrated circuit device embodying the present invention is fabricated on a single semiconductor chip 10, and largely comprises a power stabilizer 11, an internal voltage regulating unit 12 and a plurality of component circuitries 13. The power stabilizer 11 is coupled with one of the pins assigned to an external power voltage level Vcc, and distributes the external power voltage level Vcc between the internal voltage regulating unit 12 and the plurality of component circuitries 13.

The internal voltage regulating unit 12 largely comprises a reference voltage generator **12*a* and an internal power supply unit 12*b*, and the reference voltage generator 12*a* produces a variable reference voltage signal Svr. The variable reference voltage signal Svr is supplied to the internal power source unit 12*b*, and the internal power source unit 12b regulates an internal power voltage level IVcc to the variable reference voltage signal Svr. The internal power voltage level IVcc is also supplied to the component circuitries 13, and the component circuitries 13** achieve respective functions with the external power voltage level Vcc as well as with the internal power voltage level IVcc.

Figure 1:
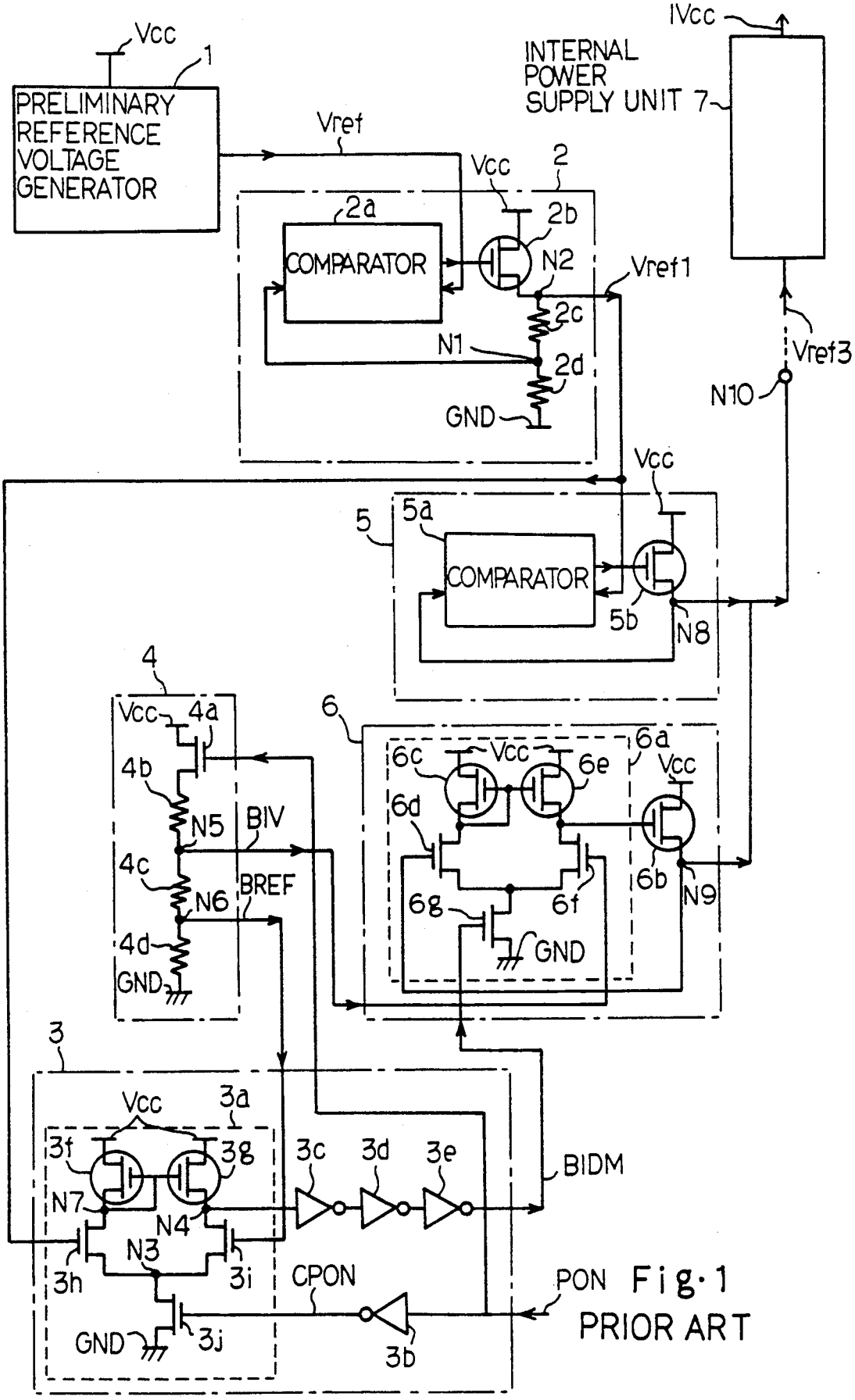
Fig. 1 PRIOR ART
FIG. 1 is a diagram showing the circuit arrangement of the prior art semiconductor integrated circuit device.
Figure 2:
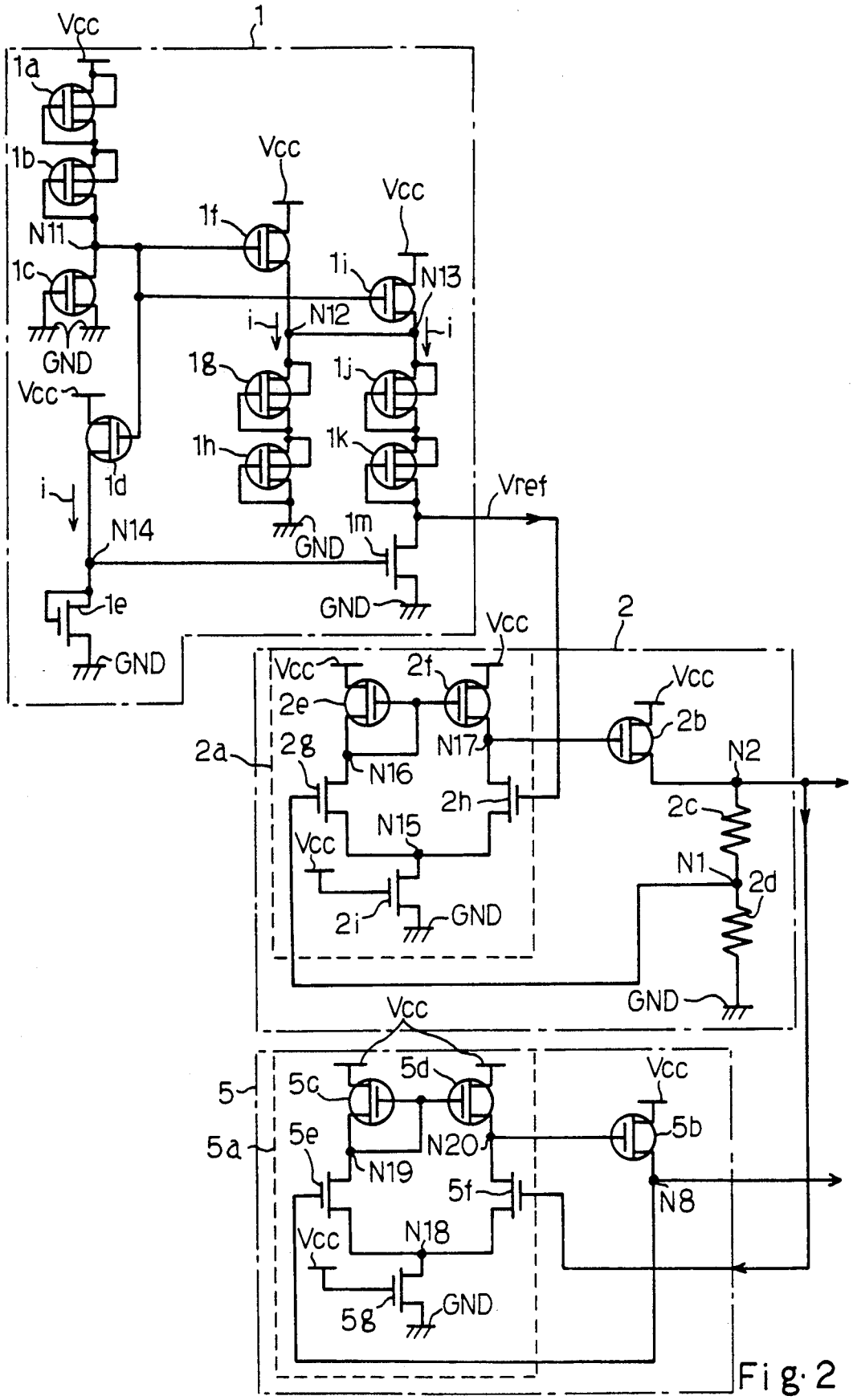
Fig. 2 PRIOR ART
FIG. 2 is a diagram showing the circuit arrangements of the reference voltage generator, the preliminary voltage regulator and the main voltage regulator incorporated in the prior art semiconductor integrated circuit device.
Figure 3:
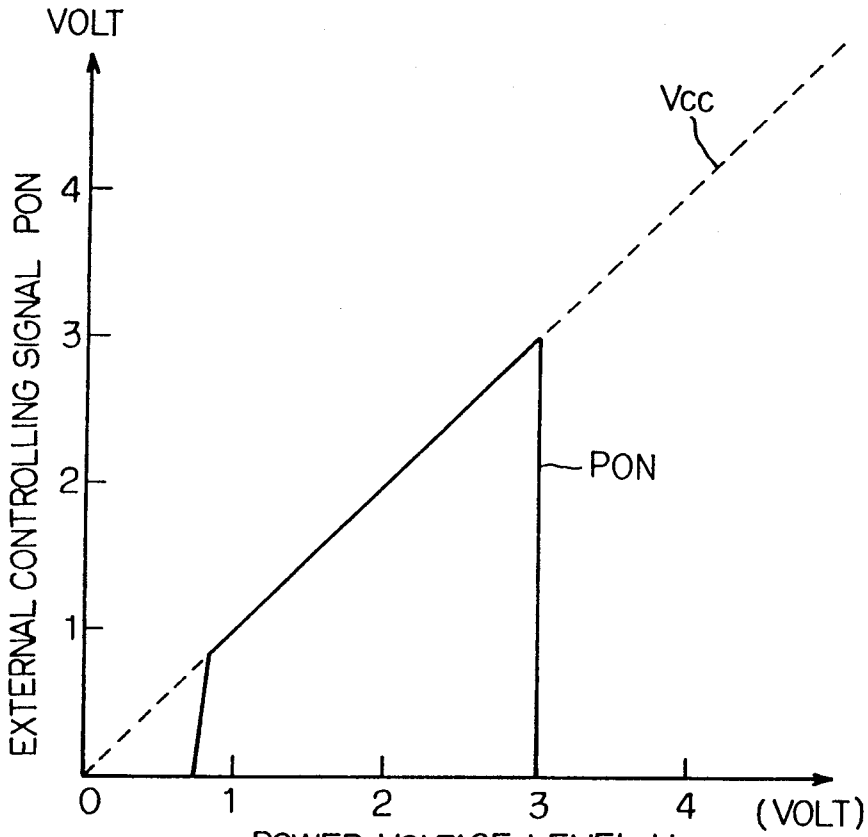
Fig. 3 PRIOR ART
FIG. 3 is a graph showing relation between the external controlling signal and the power voltage level.
Figure 4:
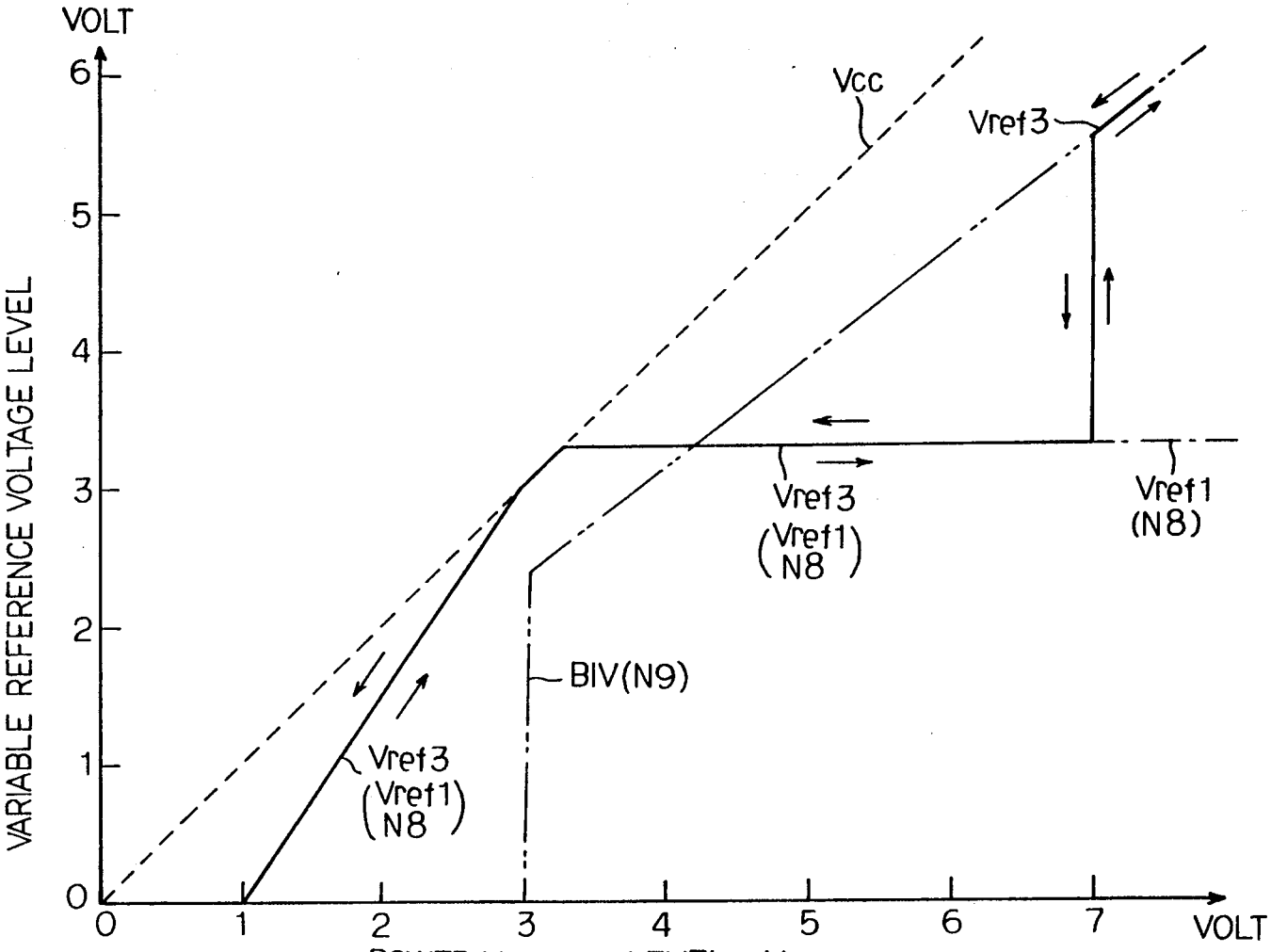
Fig. 4 PRIOR ART
FIG. 4 is a graph showing relation between the variable reference voltage level and the power voltage level.
Figure 6:
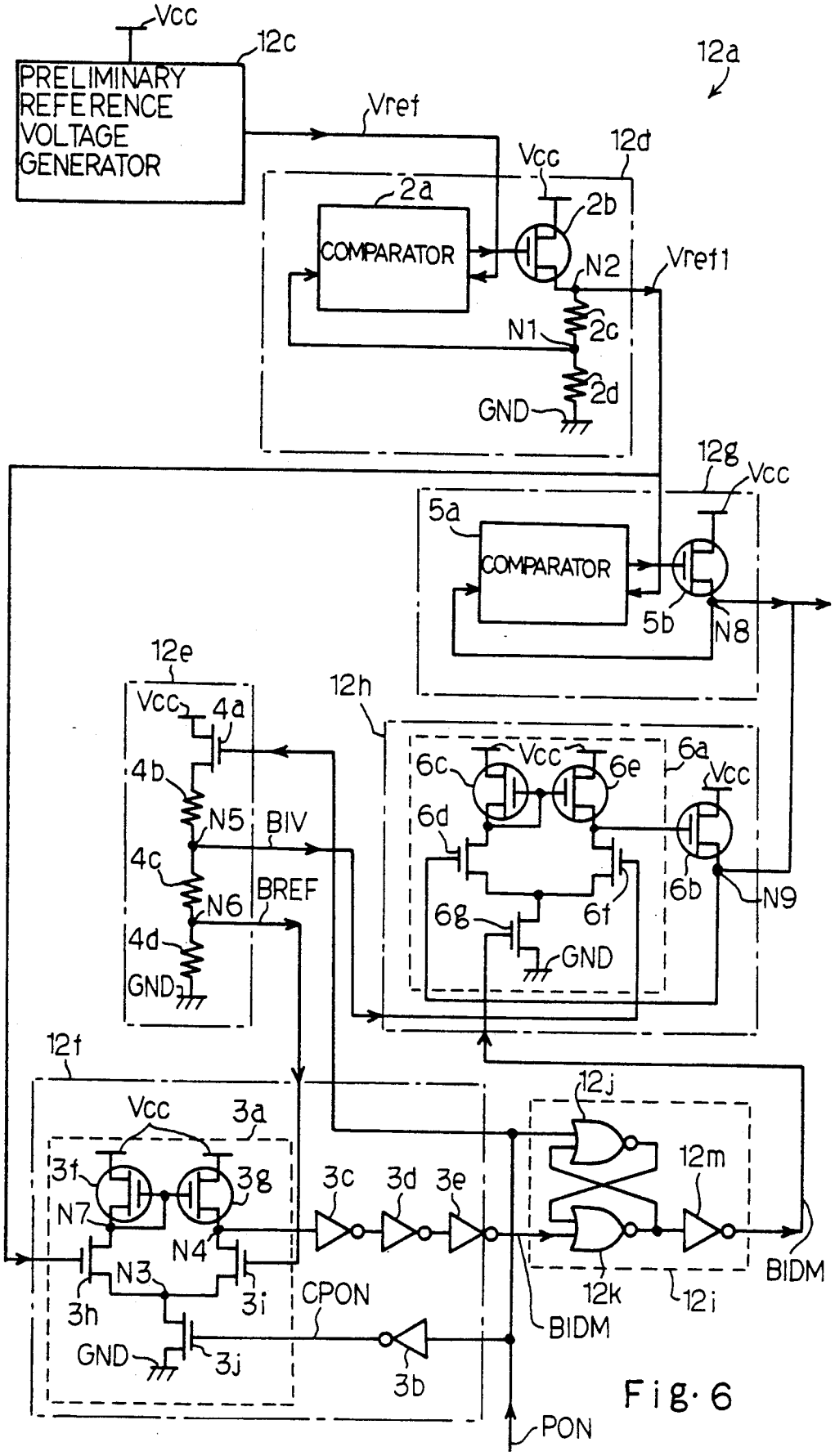
FIG. 6 is a circuit diagram showing the circuit arrangement of a reference voltage generator incorporated in the semiconductor integrated circuit device shown in FIG. 5.

The reference voltage regulator 12a is illustrated in detail in FIG. 6. The reference voltage regulator 12a comprises a preliminary reference voltage generator 12c, a preliminary voltage regulator 12d, a voltage divider 12e serving as a secondary reference voltage generator, a controller 12f, first and second main voltage regulators 12g and 12h, and a latching circuit 12i. The preliminary reference voltage generator 12c, the preliminary voltage regulator 12d, the voltage divider 12e, the controller 12f, and first and second main voltage regulators 12g and 12h are similar in circuit arrangement to the preliminary reference voltage generator 1, the preliminary voltage regulator 2, the voltage divider 4, the controller 3, the first and second main voltage regulators 5 and 6, respectively, and the circuit components thereof are labeled with the same references as those used in FIG. 1 without any detailed description.

The matching circuit 12i comprises two NOR gates 12j and 12k and an inverter 12m, and the two NOR gates 12j and 12k form in combination a flip flop circuit. The two NOR gates 12j and 12k have respective output nodes coupled with first input nodes of the other NOR gates 12k and 12j, and the external controlling signal PON and the activation signal BIDM are supplied to respective second input nodes of the NOR gates 12j and 12k. Therefore, the flip flop circuit is reset with the external controlling signal PON, and latches the activation signal BIDM. Thus, the flip flop circuit 12i continuously supplies the activation signal BIDM to the gate electrode of the n-channel enhancement type activation transistor 6g until the external controlling signal PON resets the flip flop circuit, and the second main voltage regulator 12h controls the variable reference voltage level signal Svr even if the threshold voltage level BREF temporarily becomes lower than the primary reference voltage level Vref1. This results in enhancement of stability of the internal power voltage level IVcc. In this instance, the external controlling signal PON serves as a reset signal to the latching circuit 12i.

Figure 7:
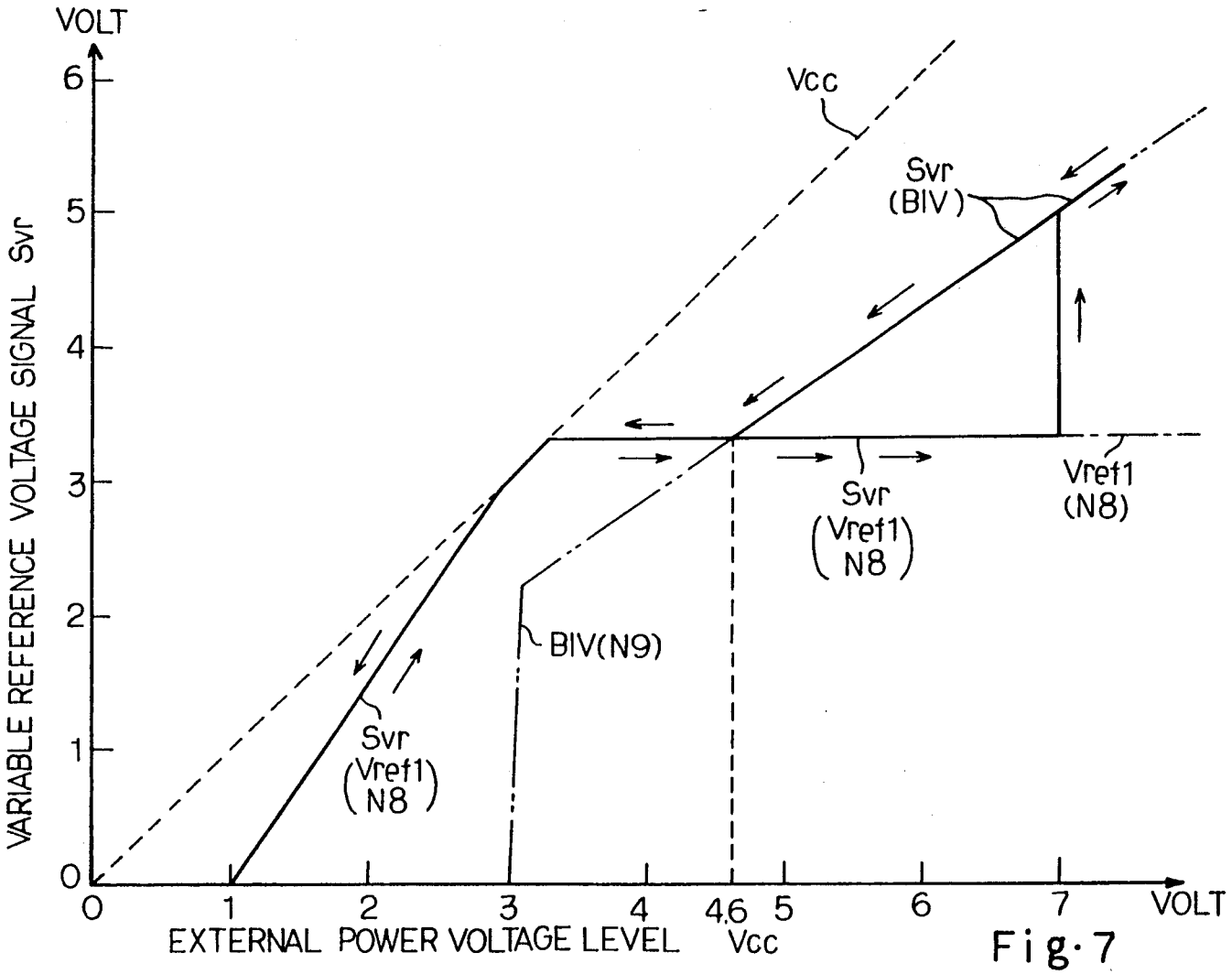
FIG. 7 is a graph showing relation between a variable reference voltage signal and an external power voltage level.

Description is made on the variable reference voltage signal Svr with reference to FIG. 7 on the assumption that Vref=1.50 volts R2c:R2d=6:5

(R4b+R4c):R4d=37:33

R4b:(R4c+R4d)=2:5

If the external power voltage level Vcc is increased from zero volt to 7.5 volts and, thereafter, decreased in vice versa. the variable reference voltage signal Svr traces Plots Svr. On the way to 7.5 volts, while the external power voltage level Vcc is less than 7.0 volts, the variable reference voltage signal Svr is regulated to the primary reference voltage level Vref1 and to the secondary reference voltage level BIV from 7.0 volts to 7.5 volts. On the other hand, while the external power voltage level Vcc is decayed from 7.5 volts to zero, the variable reference voltage signal Svr is regulated to the secondary reference voltage level BIV until 4.6 volts, then being regulated to the primary reference voltage level Vref1 again. However, the variable reference voltage signal Svr takes the above described path once and for all, because the latching circuit 12i never the first main voltage regulator 12g to regulate the variable reference voltage signal Svr. As a result, no abrupt transition takes place in the path of the variable reference voltage signal Svr, and, accordingly, the internal power source unit 12b also linearly varies the internal power voltage level IVcc depending upon the variable reference voltage signal Svr. In other words, the internal power voltage level IVcc is adjustable to any arbitrary point without attention to the abrupt transition.

Figure 8:
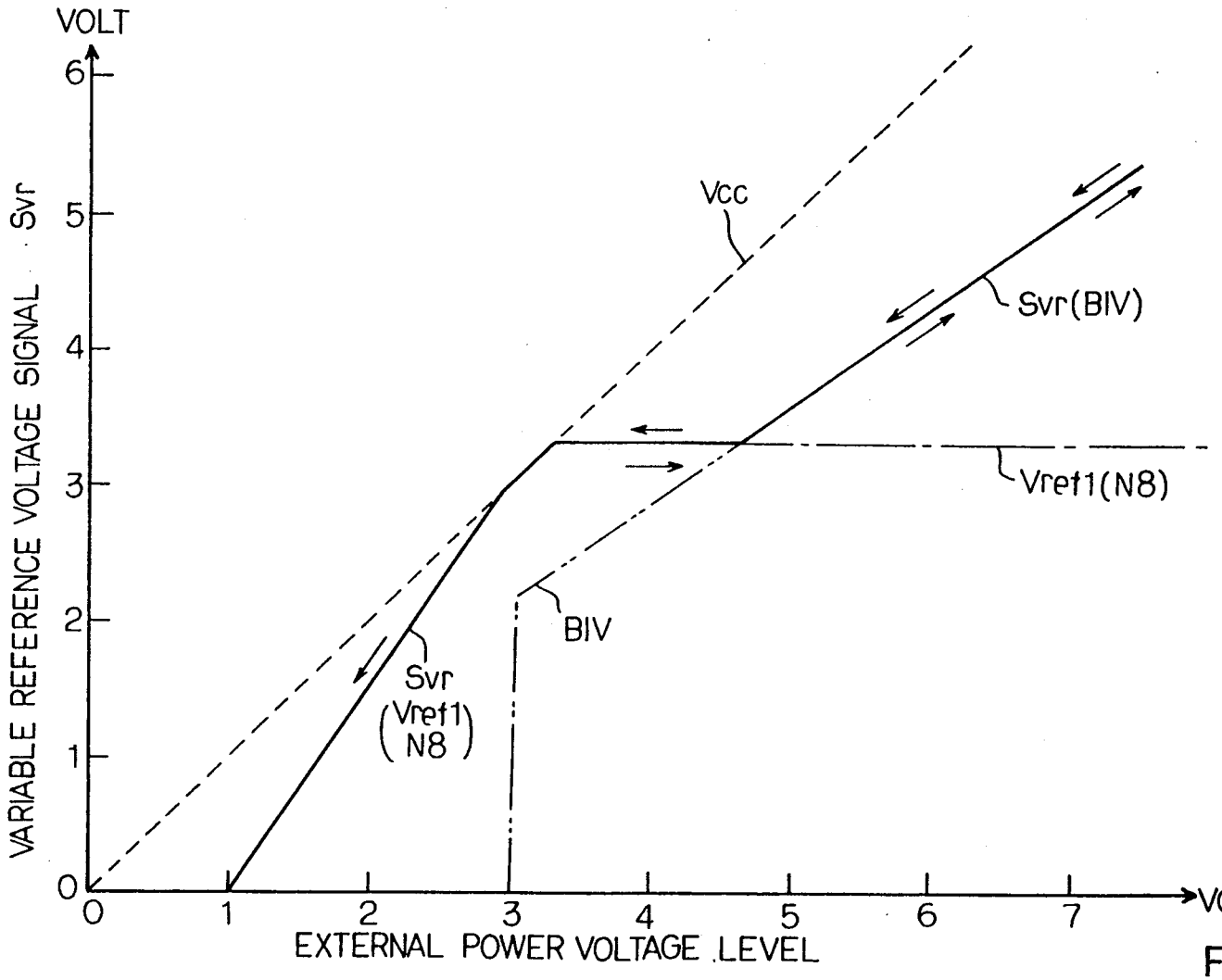
FIG. 8 is a graph showing relation between the variable reference voltage signal and the external power voltage level under an accelerating inspection.
Figure 9:
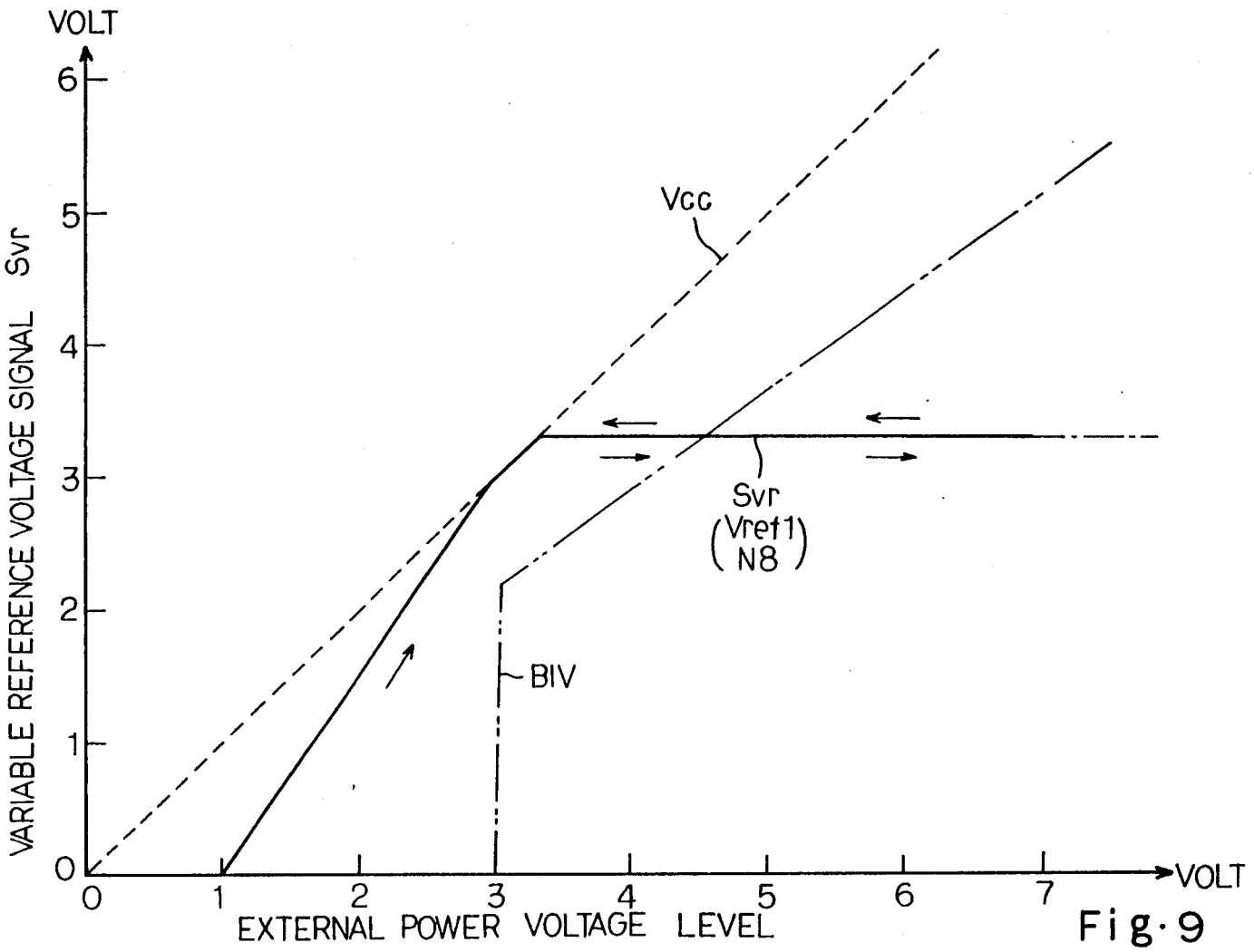
FIG. 9 is a graph showing relation between the variable reference signal and the external power voltage level in an ordinary usage.

If the semiconductor integrated circuit device is subjected to an inspection under acceleration, the external power voltage level Vcc is once increased over 7.0 volts, and is, then, regulated to any point without any abrupt transition as shown in FIG. 8. However, the external power voltage level Vcc is regulated to a predetermined point between 3.3 volts and 7.0 volts in an ordinary usage such as, for example, a system component of an electronic system, and the variable reference voltage signal Svr is regulated to the primary reference voltage level Vref1 of 3.3 volts.

Second Embodiment

Figure 10:
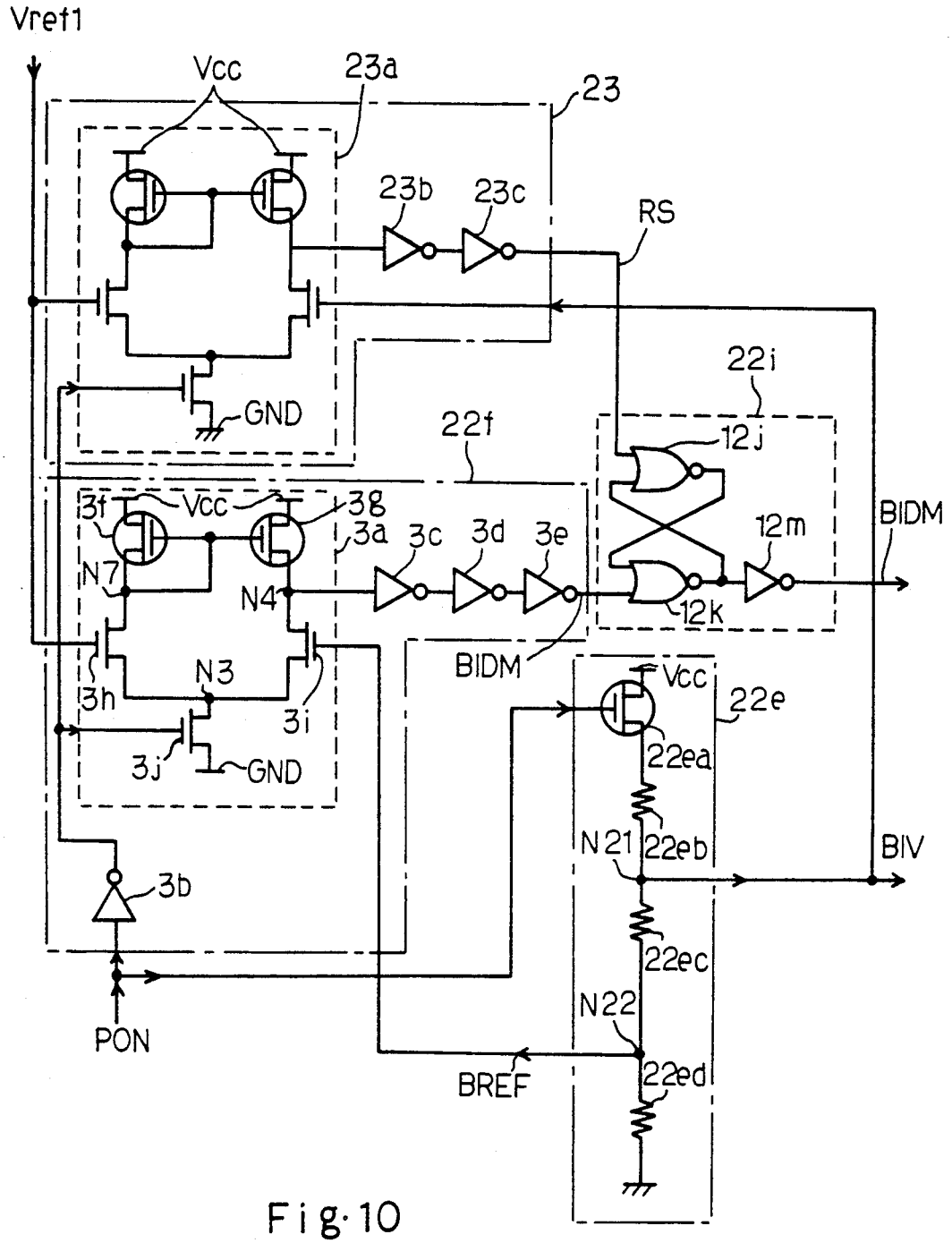
FIG. 10 is a diagram showing the circuit arrangement of another semiconductor integrated circuit device according to the present invention.

Turning to FIG. 10 of the drawings, essential component units of another semiconductor integrated circuit device embodying the present invention largely comprises a voltage divider 22e, a first controller 22f, a latching circuit 22i and a second controller 23. Although a preliminary reference voltage generator, a preliminary voltage regulator and first and second voltage regulators are incorporated in the semiconductor integrated circuit device, these component units are similar to those of the first embodiment, and are omitted from FIG. 10 for the sake of simplicity. The circuit components of the first controller 22f and the latching circuit 22i are labeled with the same references designating the corresponding circuit components of the first embodiment.

The voltage divider 22e comprises a p-channel enhancement type switching transistor 22ea and three resistors 22eb, 22ec and 22ed, and the p-channel enhancement type switching transistor 22ea is responsive to the external controlling signal PON. Intermediate nodes N21 and N22 are provided between the resistors 22eb to 22ed, and a secondary reference voltage level BIV and a threshold voltage level BREF are respectively produced at the intermediate nodes N21 and N22. The second controller 23 largely comprises a or 23a and inverters 23b and 23c, and the comparator 23a compares the primary reference voltage level Vref1 with the secondary reference voltage level Vref2. If the secondary reference voltage level BIV becomes lower than the primary reference voltage level Vref1, the comparator 23a supplies a reset signal to the latching circuit 22i, and the activation signal BIDM is not supplied to the second main voltage regulator. Thus, the second controller 23 allows the control for the variable reference voltage signal Svr to return to the first main voltage regulator without switching off the external power voltage Vcc.

As will be understood from the foregoing description, the latching circuit allows the second main voltage regulator to continuously control the variable reference voltage signal, and the internal power source unit can linearly vary the internal power voltage level without any abrupt transition depending upon the external power voltage level.

Although particular embodiments of the present invention have been shown and described, it will be obvious to those skilled in the art that various changes and modifications may be made without departing from the spirit and scope of the present invention. For example, the voltage regulating unit according to the present invention is applicable to any semiconductor integrated circuit device fabricated from miniature circuit components.

What is claimed is:

1. A semiconductor integrated circuit device comprising:

a) an internal power source unit operative to produce an internal power voltage level regulated to a variable reference voltage level; and b) a reference voltage generating unit operative to produce said variable reference voltage level, and comprising b-1) a preliminary reference voltage generator for producing a preliminary reference voltage level from an external power voltage level, b-2) a preliminary voltage regulator responsive to said preliminary reference voltage level for producing a primary reference voltage level, b-3) a secondary reference voltage generator responsive to an external controlling signal for producing a secondary reference voltage level and a threshold voltage level from said external power voltage level, b-4) a first main voltage regulator responsive to said primary reference voltage level for regulating said variable reference voltage level to said primary reference voltage level while said primary reference voltage level is higher than said threshold voltage level, b-5) a controller enabled with said external controlling signal, and operative to compare said primary reference voltage level with said threshold voltage level for producing an activation signal, b-6) a latching means shifted to a reset state with a reset signal, and latching said activation signal from said controller, and b-7) a second main voltage regulator activated with said activation signal supplied from said latching means, and responsive to said secondary reference signal for regulating said variable reference voltage level to said secondary reference voltage level after said primary reference voltage level becomes lower than said threshold voltage level.

2. A semiconductor integrated circuit device as set forth in claim 1, in which said external controlling signal serves as said reset signal supplied to said latching means.

3. A semiconductor integrated circuit device as set forth in claim 2, in which said latching means comprises first and second NOR gates having respective output nodes coupled with first input nodes of said second and first NOR gates, said external controlling signal being supplied to a second input node of said first NOR gate, said activation signal being supplied to a second input node of said second NOR gate.

4. A semiconductor integrated circuit device as set forth in claim 1, in which said reference voltage generating unit further comprises b-8) an auxiliary controller for producing said reset signal when said primary reference voltage level becomes higher than said secondary reference voltage level.

5. A semiconductor integrated circuit device as set forth in claim 4, in which said auxiliary controller comprises b-8-1) a comparator operative to compare said primary reference voltage level with said secondary reference voltage level for producing an output signal indicative of said primary reference voltage level higher than said secondary reference voltage level, and b-8-2) a plurality of inverters coupled in series, and responsive to said output signal of said comparator for producing said reset signal.

6. A semiconductor integrated circuit device as set forth in claim 5, in which said latching means comprises first and second NOR gates having respective output nodes coupled with first input nodes of said second and first NOR gates, said reset signal being supplied from said plurality of inverters to a second input node of said first NOR gate, said activation signal being supplied to a second input node of said second NOR gate.

* * * * *